US010224596B2

(12) United States Patent
Orihara

(10) Patent No.: US 10,224,596 B2
(45) Date of Patent: Mar. 5, 2019

(54) ANTENNA DEVICE AND ELECTRONIC APPARATUS

(71) Applicant: DEXERIALS CORPORATION, Tokyo (JP)

(72) Inventor: Katsuhisa Orihara, Tochigi (JP)

(73) Assignee: DEXERIALS CORPORATION, Tokyo (JP)

( * ) Notice: Subject to any disclaimer, the term of this patent is extended or adjusted under 35 U.S.C. 154(b) by 0 days.

(21) Appl. No.: 15/576,538

(22) PCT Filed: May 2, 2016

(86) PCT No.: PCT/JP2016/063579
§ 371 (c)(1),
(2) Date: Nov. 22, 2017

(87) PCT Pub. No.: WO2016/194542
PCT Pub. Date: Dec. 8, 2016

(65) Prior Publication Data

US 2018/0151941 A1 May 31, 2018

(30) Foreign Application Priority Data

May 29, 2015 (JP) ..... 2015-109906

(51) Int. Cl.
*H01Q 7/06* (2006.01)
*H01Q 1/22* (2006.01)
*H01Q 1/38* (2006.01)

(52) U.S. Cl.
CPC ..... *H01Q 1/2216* (2013.01); *H01Q 1/38* (2013.01); *H01Q 7/06* (2013.01)

(58) Field of Classification Search
CPC .. H01Q 1/22–1/2216; H01Q 7/00; H01Q 7/06
(Continued)

(56) References Cited

U.S. PATENT DOCUMENTS 9,070,970 B2 * 6/2015 Kubo ..... H01Q 1/2216
2005/0162331 A1 * 7/2005 Endo ..... G06K 7/10336 343/788

(Continued)

FOREIGN PATENT DOCUMENTS

JP 4013987 B1 11/2007
JP 2011-211309 A 10/2011

(Continued)

OTHER PUBLICATIONS

Jun. 14, 2016 International Search Report issued in International Patent Application No. PCT/JP2016/063579.

*Primary Examiner* — Dameon E Levi
*Assistant Examiner* — Hasan Z Islam
(74) *Attorney, Agent, or Firm* — Oliff PLC

(57) ABSTRACT

The purpose of the present invention is to provide an antenna device that makes it possible to ensure satisfactory communication performance even when the antenna device is mounted in an electronic apparatus with limited mounting space. An antenna device, incorporated in an electronic apparatus, which communicates with an external device via an electromagnetic field signal, comprising: a metal plate provided inside a housing of the electronic apparatus and facing the external device, and an antenna coil provided by winding a conducting wire in a approximately rectangular shape so that parts of the conducting wire that face each other in a width direction via an opening of the antenna coil come close to each other, and inductively coupled to the external device, wherein the antenna coil is provided along a side face of the metal plate.

12 Claims, 14 Drawing Sheets

(58) Field of Classification Search
USPC ..... 343/787, 788
See application file for complete search history.

(56) References Cited

U.S. PATENT DOCUMENTS

| | | | | |
|---|---|---|---|---|
| 2009/0189729 | A1* | 7/2009 | Kubo ..... | G06K 19/07749 336/221 |
| 2011/0234014 | A1 | 9/2011 | Kato et al. | |
| 2013/0171479 | A1 | 7/2013 | Kim et al. | |
| 2014/0125538 | A1 | 5/2014 | Kanj et al. | |

FOREIGN PATENT DOCUMENTS

| | | | |
|---|---|---|---|
| JP | 2012-147407 | A | 8/2012 |
| JP | 2012-217133 | A | 11/2012 |
| JP | 5472153 | B2 | 4/2014 |
| JP | 2015-088951 | A | 5/2015 |

* cited by examiner

ANTENNA DEVICE AND ELECTRONIC APPARATUS

BACKGROUND OF THE INVENTION

Field of the Invention

The present invention relates to an antenna device, incorporated in an electronic apparatus, which communicates with an external device such as a transmitter via an electromagnetic field signal and to an electronic apparatus including such an antenna device. The present application claims priority based on Japanese Patent Application No. 2015-109906 filed in Japan on May 29, 2015. The total contents of the patent application are to be incorporated by reference into the present application.

Description of Related Art

Electronic apparatuses such as mobile phones use antenna modules for RFID (radio frequency identification) in order to have short-distance non-contact communications capabilities. Such an antenna module communicates with an antenna coil of a transmitter such as a reader-writer by means of inductive coupling. That is, such an antenna module allows a magnetic field from the reader-writer to be received by the antenna coil to be converted into electric power to drive an IC that functions as a communication processing unit.

In order to surely perform communication, the antenna module needs to receive magnetic flux of a certain or higher value from the reader-writer with the antenna coil. For that purpose, in an antenna module according to a conventional example provides a housing of a mobile phone or the like with a loop coil and receives magnetic flux from a reader-writer with this coil. An antenna module incorporated in an electronic apparatus such as a mobile phone may cause magnetic flux from a reader-writer to be rebounded due to an eddy current produced by reception of the magnetic field from the reader-writer by a metal plate of a substrate, a battery pack, or the like inside the device. For example, in the case of a housing surface of a mobile phone, a magnetic field coming from a reader-writer tends to be strong in the outer regions of the housing surface and weak near the middle of the housing surface.

For this reason, in order to enhance the communication efficiency of an NFC antenna module that is built in an electronic apparatus for use, a method for arranging the NFC antenna module at an end of a metal plate of a substrate, a battery pack, or the like inside the device is currently under development. As examples of the method for arranging an NFC antenna module at an end of a metal plate, Patent Literatures 1 and 2 each propose a method for folding a part of a magnetic body over a side part and Patent Literature 3 proposes an elongated antenna device that is mounted between a metal plate and a housing.

Patent Literature 1: JP 4013987 B

Patent Literature 2: JP 5472153 B

Patent Literature 3: JP 2012-217133 A

SUMMARY OF THE INVENTION

However, the type folding a part of a magnetic body over a side face raises concern about limitations on mounting due to an additional thickness of the magnetic body. Further, the type that mounts an elongated antenna device in the space between a metal plate and a housing has had a problem such as the incapability of mounting the antenna device in a case where there is no sufficient space to provide the antenna device between the main metal plate and the housing. In particular, since advances in miniaturization and functionalization of electronic apparatuses put more and more limitations on mounting space for antenna devices, it is necessary to ensure satisfactory communication performance while achieving mountability in a narrow space by placing an antenna device in such a manner that the antenna device is folded along an end of a metal plate of a battery, an LCD module, or the like.

The present invention has been made in view of the foregoing problems, and it is an object of the present invention to provide a novel and improved antenna device and electronic apparatus that make it possible to ensure satisfactory communication performance even when an antenna coil is mounted in an electronic apparatus with limited mounting space in such a manner that the antenna coil is folded along an end of a metal plate.

A first aspect of the present invention is directed to an antenna device, incorporated in an electronic apparatus, which communicates with an external device via an electromagnetic field signal, including: a metal plate provided inside a housing of the electronic apparatus and facing the external device; an antenna coil provided by winding a conducting wire in an approximately rectangular shape so that parts of the conducting wire that face each other in a width direction via an opening of the antenna coil come close to each other, configured such that a width of the antenna coil is larger than a thickness of the metal plate, and inductively coupled to the external device; and a magnetic sheet formed of a magnetic substance and provided in such a manner as to overlap with a part of the antenna coil, wherein the antenna coil is provided along a side face of the metal plate and configured such that a portion of the antenna coil that protrudes from a region overlapping the side face of the metal plate is folded along at least either a top or bottom face of the metal plate.

According to the first aspect of the present invention, the antenna device is provided along the side face of the metal plate, and the portion of the antenna coil that protrudes from the side face of the metal plate is folded along the bottom face or the like of the metal plate. This makes it possible to ensure satisfactory communication performance even when the antenna device is mounted in a limited narrow space near the side face of the metal plate.

At this time, in the first aspect of the present invention, the magnetic sheet may be provided through the opening in such a manner as to overlap with a part of the antenna coil.

This makes it possible to induce, toward the center of the antenna coil, magnetic flux that is sent from the external device at the time of communication, thus making it possible to mount the antenna device in a limited narrow space near the side face of the metal plate while achieving satisfactory communication characteristics of an antenna.

Further, in the first aspect of the present invention, the antenna coil may be divided into two parts at a center line longitudinally traversing the opening in a longitudinal direction of the antenna coil, the two parts being one side part in which the conducting wire turns around in one direction and other side part in which the conducting wire turns around in other direction, the magnetic sheet may be provided through the opening in such a manner as to overlap with an outer side of the one side part and overlap with an inner side of the other side part, and the antenna coil may be configured such that the one side part directly faces the side face of the metal plate and the other side part is folded along the bottom face of the metal plate.

This makes it possible to further widen the distribution of a magnetic field that is produced in the antenna coil, thus making it possible to ensure satisfactory communication performance even when the antenna device is folded and mounted in a limited narrow space near the side face of the metal plate.

Further, in the first aspect of the present invention, the antenna coil may be divided into two parts at a center line longitudinally traversing the opening in a longitudinal direction of the antenna coil, the two parts being one side part in which the conducting wire turns around in one direction and other side part in which the conducting wire turns around in other direction, the magnetic sheet may be provided through the opening in such a manner as to overlap with an inner side of the one side part and overlap with an outer side of the other side part, and the antenna coil may be configured such that the one side part faces the side face of the metal plate via the magnetic sheet and the other side part is folded along the bottom face of the metal plate.

This makes it possible to further widen the distribution of a magnetic field that is produced in the antenna coil, thus making it possible to ensure satisfactory communication performance even when the antenna device is folded and mounted in a limited narrow space near the side face of the metal plate.

Further, in the first aspect of the present invention, the antenna coil may be divided into two parts at a center line longitudinally traversing the opening in a longitudinal direction of the antenna coil, the two parts being one side part in which the conducting wire turns around in one direction and other side part in which the conducting wire turns around in other direction, and the magnetic sheet may be provided in such a manner as to overlap with only either the one side part or the other side part.

This makes it possible to further widen the distribution of a magnetic field that is produced in the antenna coil, thus making it possible to ensure satisfactory communication performance even when the antenna device is folded and mounted in a limited narrow space near the side face of the metal plate.

Further, in the first aspect of the present invention, the antenna coil may be divided into two parts at a center line longitudinally traversing the opening in a longitudinal direction of the antenna coil, the two parts being one side part in which the conducting wire turns around in one direction and other side part in which the conducting wire turns around in other direction, and the antenna coil may be configured such that an end side of the one side part is folded along the top face of the metal plate and an end side of the other side part is folded along the bottom face of the metal plate.

With this, the distribution of a magnetic field that is produced by the antenna coil can be spread over an area including both the top face side and back face side of the metal plate. This makes it possible to achieve satisfactory communication characteristics of an antenna while mounting the antenna device in a limited narrow space near the side face of the metal plate.

Further, a second aspect of the present invention is directed to an electronic apparatus that is able to communicate with an external device via an electromagnetic field signal, including the antenna device according to any of the foregoing.

The second aspect of the present invention makes it possible to ensure satisfactory antenna communication characteristics even when the antenna device is mounted in a limited narrow space, thus bringing about improvement in degree of freedom of design of an electronic apparatus that can ensure satisfactory antenna communication characteristics.

As described above, by providing the antenna coil so that the antenna coil is folded along the side face of the metal plate, the present invention makes it possible to ensure satisfactory communication performance even in a case where the antenna device is mounted in a limited narrow space near the side face of the metal plate.

DETAILED DESCRIPTION OF THE. INVENTION

In the following, preferred embodiments of the present invention are described in detail. It should be noted that the present embodiment to be described below is not intended to unduly limit the contents of the present invention as recited in the claims and not all of the configurations to be described in the present embodiment are essential as means for solving the problems of the present invention.

Figure 1:
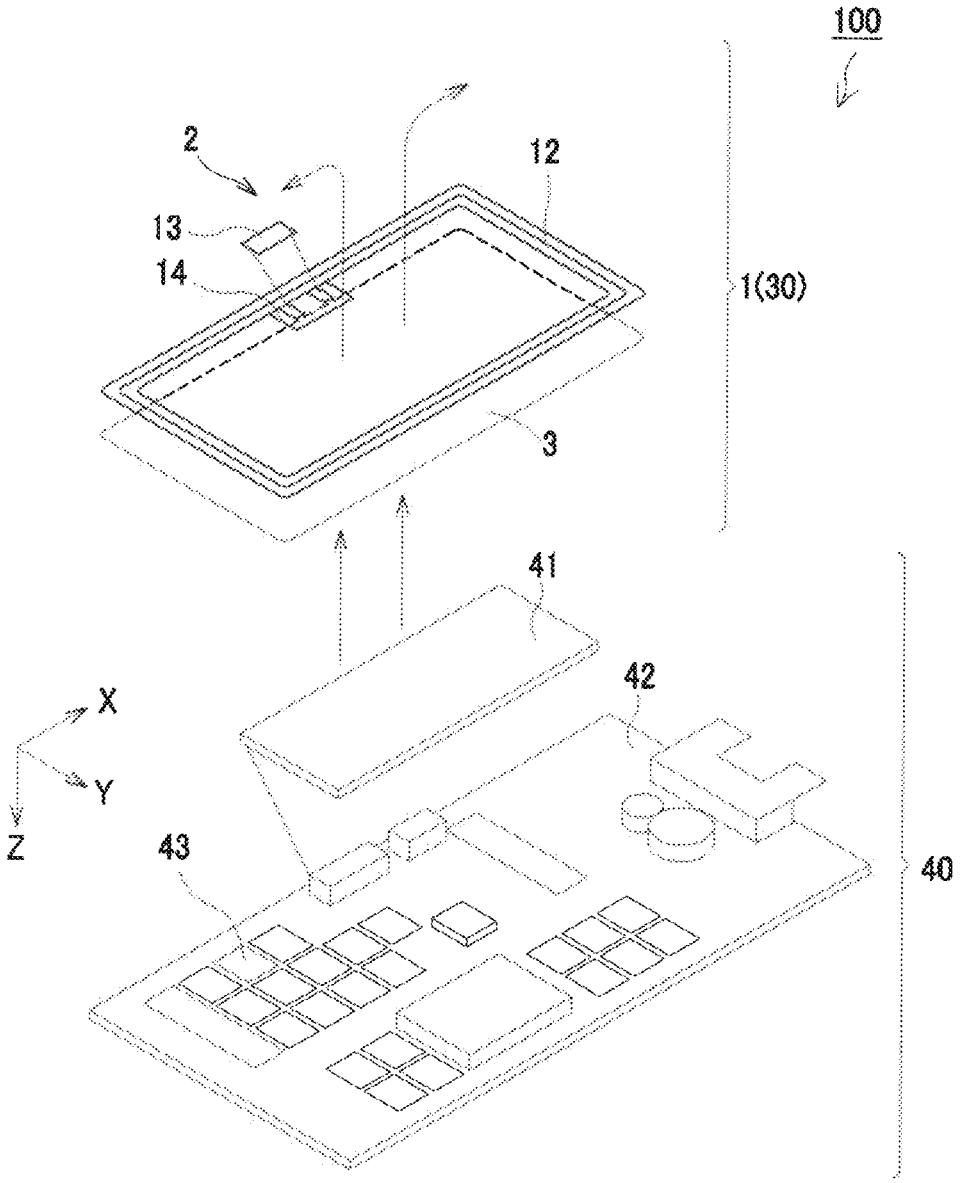
FIG. 1 is a perspective view schematically showing a configuration of a wireless communication system to which an antenna device according to an embodiment of the present invention is applied.
Figure 2A:
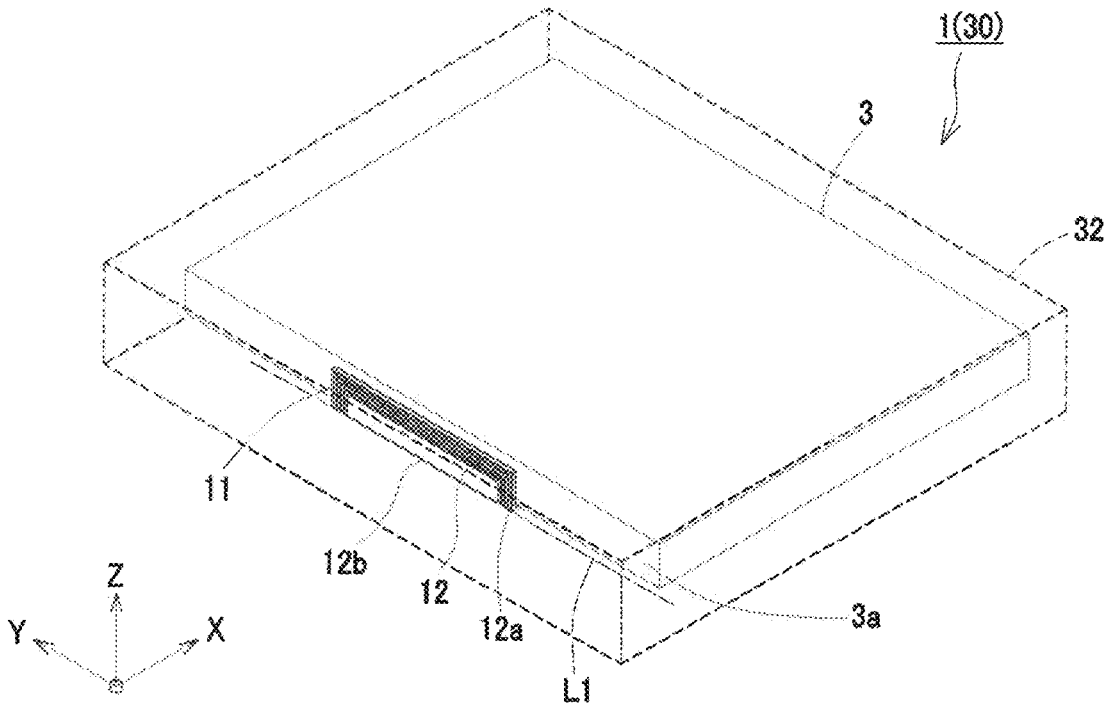
FIG. 2A is a perspective view showing an example of an antenna device according to an embodiment of the present invention.
Figure 2B:
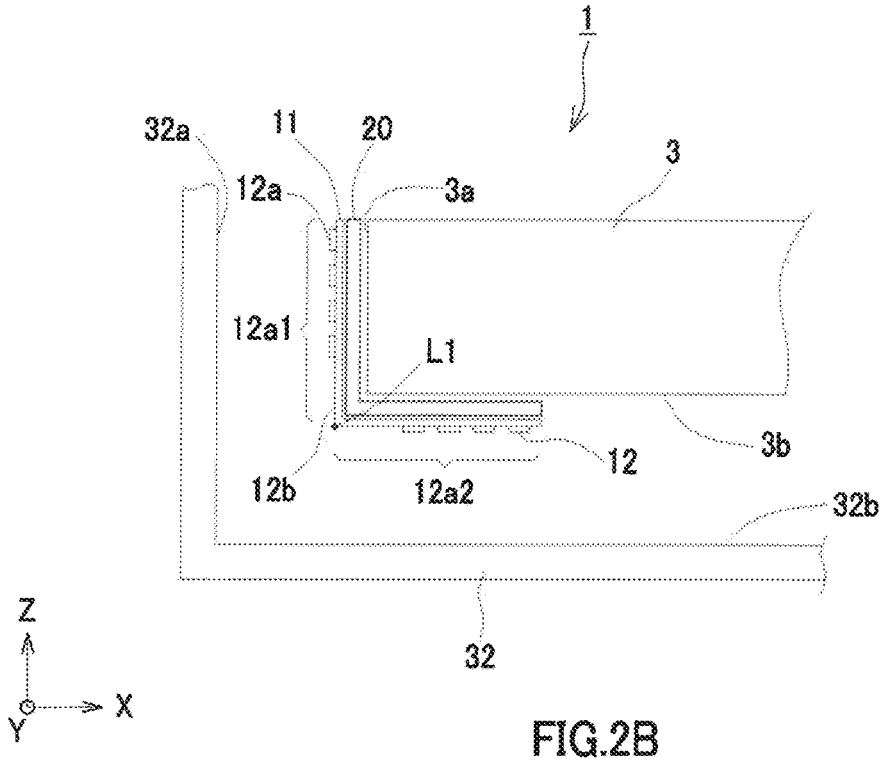
FIG. 2B is a cross-sectional view for explaining the arrangement of an antenna device according to an embodiment of the present invention.

First, a configuration of an antenna device according to an embodiment of the present invention is described with reference to the drawings. FIG. 1 is a perspective view schematically showing a configuration of a wireless communication system to which an antenna device according to an embodiment of the present invention is applied. FIG. 2A is a perspective view showing an example of an antenna device according to an embodiment of the present invention. FIG. 2B is a cross-sectional view for explaining the arrangement of an antenna device according to an embodiment of the present invention.

An antenna device 1 according to the present embodiment is a device, incorporated in an electronic apparatus 30, which communicates with an external device via an electromagnetic field signal. For example, as shown in FIG. 1, the antenna device 1 is incorporated in a wireless communication system 100 for RFID for use.

As shown in FIG. 1, the wireless communication system 100 includes the antenna device 1, which is included in the electronic apparatus 30, and a reader-writer 40 serving as an external device that makes access to the antenna device 1. Assume here that the antenna device 1 and the reader-writer 40 are arranged to face each other at the XY plane of the three-dimensional orthogonal coordinate system XYZ shown in FIG. 1.

The reader-writer 40 functions as a transmitter that transmits a magnetic field in a Z-axis direction toward the antenna device 1, which faces the reader-writer 40 at the XY plane. Specifically, the reader-writer 40 includes an antenna 41 that transmits a magnetic field toward the antenna device 1 and a control board 42 that communicates with the antenna device 1, which is inductively coupled, via the antenna 41.

That is, the reader-writer 40 is provided with the control board 42 electrically connected to the antenna 41. This control board 42 is mounted with a control circuit 43 composed of one or more electronic components such as integrated circuit chips. This control circuit 43 executes various types of process on the basis of data received from the antenna device 1.

For example, in a case where the control circuit 43 transmits data to the antenna device 1, the control circuit 43 codes the data, modulates a carrier wave of a predetermined frequency (e.g. 13.56 MHz) on the basis of the data thus coded, amplifies the modulated signal thus modulated, and drives the antenna 41 with the modulated signal thus amplified. Further, in a case where the control circuit 43 reads out data from the antenna device 1, the control circuit 43 amplifies a modulated signal of data received by the antenna 41, demodulates the modulated signal of data thus amplified, and decodes the data thus demodulated.

It should be noted that the control circuit 43 uses a coding scheme and a modulation scheme that are used by a common reader-writer; for example, the control circuit 43 uses a Manchester coding scheme and an ASK. (amplitude shift keying) modulation scheme. Further, the following describes an antenna device and the like in a non-contact communication system but assumes that a non-contact charging system such as Qi can be similarly applied.

The antenna device 1 is, for example, incorporated into a housing 32 of the electronic apparatus 30, such as a mobile phone, which is arranged to face the reader-writer 40 at the XY plane. In the present embodiment, the antenna device 1 includes an antenna module 2, a communication processing unit 13, and a metal plate 3. The antenna module 2 includes an antenna substrate 11 (see FIG. 2A) mounted with an antenna coil 12 that becomes able to communicate with the reader-writer 40, which is inductively coupled. The communication processing unit 13 is driven by an electric current flowing through the antenna coil 12 and communicates with the reader-writer 40.

The antenna module 2 is provided inside the housing 32 (see FIG. 2A) of the electronic apparatus 30 and communicates with the reader-writer 40, which is inductively coupled. In the present embodiment, as shown in FIG. 1, the antenna module 2 includes the antenna substrate 11, the communication processing unit 13, and a terminal area 14.

The antenna substrate 11 is mounted with the antenna coil 12 and the terminal area 14. The antenna coil 12 is formed by a patterning process or the like of a flexible conducting wire 12*a* such as a flexible flat cable. The terminal area 14 electrically connects the antenna coil 12 and the communication processing unit 13 to each other.

The antenna coil 12 has a function of, upon receipt of a magnetic field that is transmitted from the reader-writer 40, being magnetically coupled to the reader-writer 40 by inductive coupling, receiving a modulated electromagnetic wave, and supplying the received signal to the communication processing unit 13 via the terminal area 14. In the present embodiment, as shown in FIG. 2*i*, the antenna coil 12 has an approximately rectangular shape elongated in a longitudinal direction, has its single conductive wire 12*a* turned around the edge thereof, and has an opening 12*b* located on a center side thereof. That is, the antenna coil 12 is provided by winding the conducting wire 12*a* so that parts of the conducting wire 12*a* that face each other in a width direction (i.e. an X direction shown in FIG. 2A) via the opening 12*b* come close to each other. Further, the antenna coil 12 has a principal surface on which the conducting wire 12*a* is turned around, and is arranged so that, at the time of communication, the principal surface faces the reader-writer 40 at the XY plane shown in FIG. 1.

The communication processing unit 13 is driven by an electric current flowing through the antenna coil 12 and communicates with the reader-writer 40. Specifically, the communication processing unit 13 demodulates a received modulated signal, decodes the data thus demodulated, and writes the data thus decoded into an internal memory of the communication processing unit 13. Further, the communication processing unit 13 reads out, from the internal memory, data to be transmitted to the reader-writer 40, codes the data thus read out, modulates the carrier wave on the basis of the data thus coded, and transmits the radio wave thus modulated to the reader-writer 40 via the antenna coil 12, which is magnetically coupled by inductive coupling. It should be noted that the communication processing unit 13 may be driven not by electric power flowing through the antenna coil 12 but by electric power supplied from electricity supply means, such as a battery pack or an external power source, incorporated in the electronic apparatus 30.

The metal plate 3 is provided in the housing 32 of the electronic apparatus 30 and serves as a first electric conductor that faces the reader-writer 40, which serves as an external device. The metal plate 3 is, for example, provided in a housing of an electronic apparatus such as a mobile phone, a smartphone, or a tablet PC, and constitutes the first electric conductor, which faces the reader-writer 40, at the time of communication of the antenna module 2. The first electric conductor is equivalent, for example, to a metal cover attached to an inner surface of a housing of a smartphone, a metal housing of a battery pack contained in a smartphone, a metal plate provided on the back face of a liquid crystal module of a tablet PC, or the like.

Since the metal plate 3 of a battery pack or the like allows passage of electricity comparatively well, the application of an AC magnetic field from an outside source produces an eddy current that undesirably rebounds the magnetic field. An examination of a magnetic field distribution at the time of the application of an AC magnetic field from an outside source shows such a characteristic that the magnetic field is strong on an outer edge side of the metal plate 3 facing the reader-writer 40. For this reason, in the present embodiment, the antenna coil 12 of the antenna module 2 is provided on the outer edge side of the metal plate 3 of a battery pack or the like provided inside the housing 32 of the mobile phone 30. Such provision of the antenna coil 12 on the outer edge side of the metal plate 3 makes it possible to achieve satisfactory communication characteristics with the reader-writer 40 while achieving miniaturization of the electronic apparatus 30 such as a mobile phone at the time of incorporation into the electronic apparatus 30.

In the present embodiment, the antenna coil 12 is for example on the XZ plane of such a three-dimensional orthogonal coordinate system XYZ as that shown in FIG. 2A. As shown in FIG. 2B, the antenna coil 12 is arranged between a side face 3*a* of the metal plate 3 of a battery pack or the like provided inside the housing 32 of the mobile phone 30 and an inner peripheral wall 32*a* of the housing 32. The antenna coil 12 is provided along the side face 3*a* of the metal plate 3. That is, the antenna coil 12 is provided so that the opening 12*b* faces not a top face side of the metal plate 3 that faces the reader-writer 40 but the side face 3*a*.

Further, n the present embodiment, the antenna coil 12 is provided by winding the conducting wire 12*a* into an approximately rectangular shape, and is configured to be divided into two parts at a center line L1 longitudinally traversing the opening 12*b* in a longitudinal direction of the antenna coil 12, the two parts being one side part 12*a*1 in which the conducting wire 12*a* turns around in one direction and other side part 12*a*2 in which the conducting wire 12*a* turns around in other direction. Furthermore, in order to enhance communication performance by producing a greater induced electromotive force with the antenna coil 12, the present embodiment is configured such that, as shown in FIG. 2B, the width of the antenna coil 12 is larger than the thickness of the metal plate 3.

Moreover, in the present embodiment, the antenna device 1 is configured such that a portion of the antenna coil 12 that protrudes from a region overlapping the side face 3*a* of the metal plate 3 is folded along a bottom face 3*b* of the metal plate 3. In the present embodiment, as shown in FIG. 2B, the other side part 12*a*2 is the portion of the antenna coil 12 that protrudes from the region overlapping the side face 3*a* of the metal plate 3; therefore, the other side part 12*a*2 is configured to be folded along the bottom face 3*b* of the metal plate 3.

Furthermore, in the present embodiment, as shown in FIGS. 2A and 2B, a magnetic sheet 20 is provided in such a manner to overlap with a part of the antenna coil 12 for more satisfactory antenna communication performance. The magnetic sheet 20 is formed of a magnetic substance such as iron oxide, chromium oxide, cobalt, or ferrite. In order to enhance the communication characteristics of the antenna module 2 (see FIG. 1), the magnetic sheet 20 has a function of inducing, toward the center side of the antenna coil 12, magnetic flux that is sent from the reader-writer 40 (see FIG. 1) at the time of communication of the antenna module 2.

Thus, the present embodiment is configured such that the approximately rectangular antenna coil 12, which is elongated in the longitudinal direction and whose width is larger than the thickness of the metal plate 3, is folded at the center line L1 so that the one side part 12*a*1 is arranged in a narrow space between the side face 3*a* of the metal plate 3 and the inner peripheral wall 32*a* of the housing 32 of the electronic apparatus 30 and the other side part 12*a*2 is arranged in a narrow space between the bottom face 3*b* of the metal plate 3 and a bottom face 32*b* of the housing 32. The present inventor diligently studied to attain the aforementioned object of the present invention. As a result, the present inventor found that particularly in a case where the shape of the antenna coil 12 is an approximately rectangular shape elongated in a longitudinal direction and the width of the antenna coil 12 is larger than the thickness of the metal plate 3, a satisfactory communication function can be maintained without deterioration in communication performance of the antenna device 1 even when the antenna coil 12 is not provided on a side of the metal plate 3 that faces the reader-writer 40 but folded so that the one side part 12*a*1 faces the side face 3*a* of the metal plate 3 and the other side part 12*a*2 faces the bottom face 3*b* of the metal plate 3.

For this reason, the present embodiment ensures satisfactory communication performance even in the case of mounting in a limited narrow space by providing the antenna coil 12 along the side face 3*a* of the metal plate 3 first and then folding the antenna coil 12 at the center line L1 to provide the other side part 12*a*2 along the bottom face 3*b* of the metal plate 3, thus making it possible to respond to a request for miniaturization of the electronic apparatus 30. Further, even when the area of the antenna coil 12 is made larger for enhanced communication performance of the antenna device 1, mounting in a narrow space inside the electronic apparatus 30 is made possible without deterioration in communication performance by providing the antenna coil 12 along the side face 3*a* of the metal plate 3 first and then folding the antenna coil 12 to provide the other side part 12*a*2, which serves as a portion of the antenna coil 12 that protrudes from the side face 3*a* of the metal plate 3, along the bottom face 3*b* of the metal plate 3. This brings about improvement in degree of freedom of design of the electronic apparatus 30.

Figure 3A:
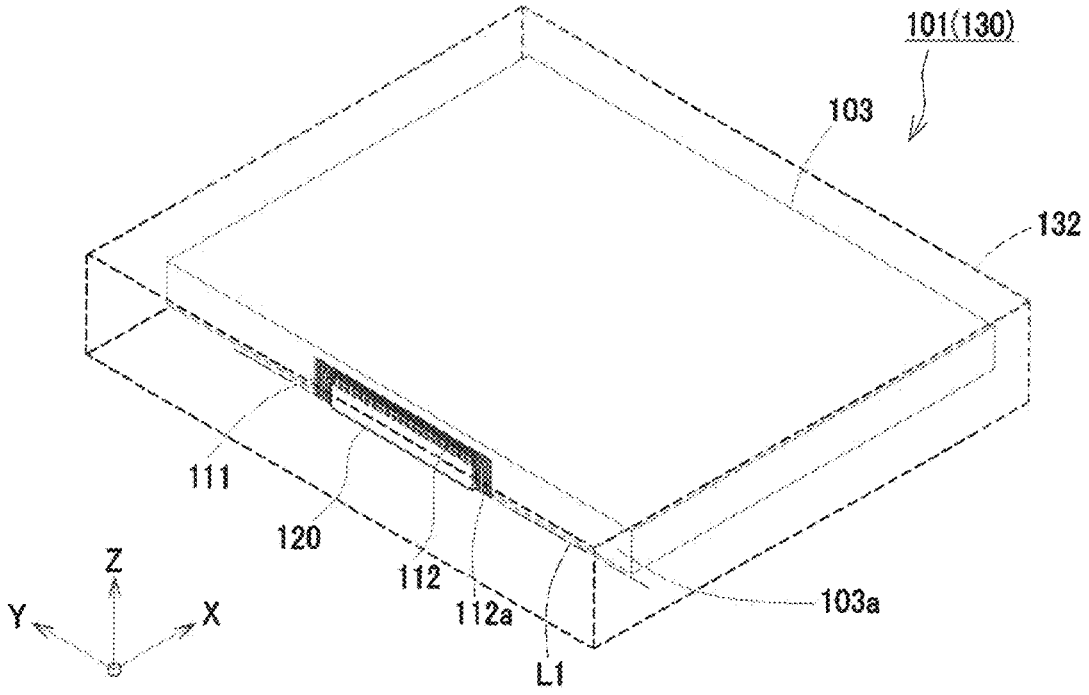
FIG. 3A is a perspective view showing an example of an antenna device according to another embodiment of the present invention.
Figure 3B:
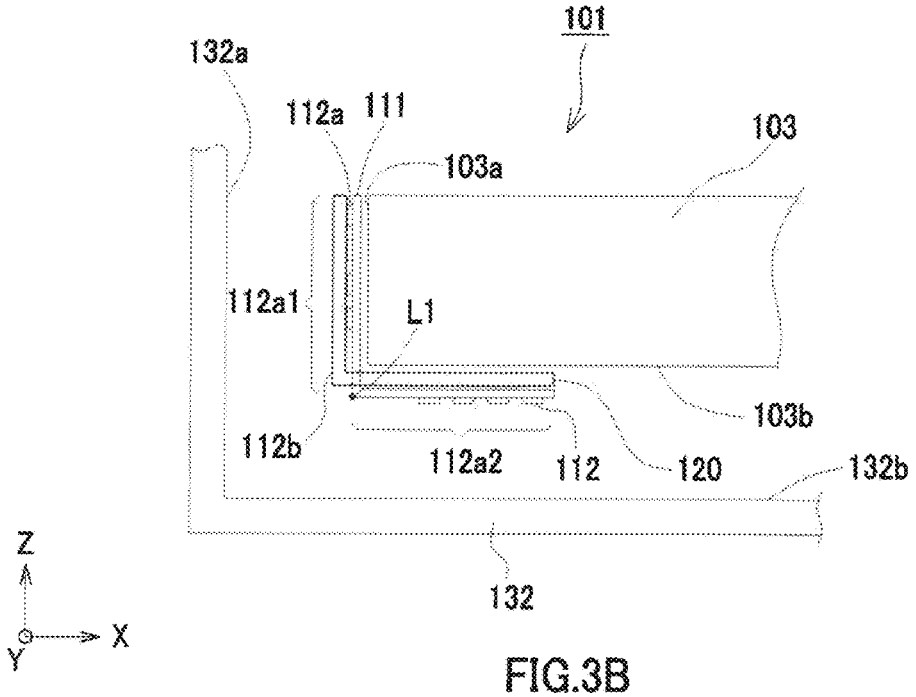
FIG. 3B is a cross-sectional view for explaining the arrangement of an antenna device according to another embodiment of the present invention.

It should be noted that the antenna device 1 according to an embodiment of the present invention is not limited in configuration to FIGS. 2A and 2B. That is, in order to improve the communication characteristics of an antenna by inducing, toward the center of an antenna coil 112, magnetic flux that is sent from an external device at the time of communication, an antenna device 101 may be configured such that, as shown in FIGS. 3A and 3B, a magnetic sheet 120 is provided through an opening 112*b* of the antenna coil 112 in such a manner as to overlap with a part of the antenna coil 112.

In the present embodiment, the magnetic sheet 120 is provided through the opening 112*b* in such a manner as to overlap with an outer side of one side part 112*a*1 and overlap with an inner side of other side part 112*a*2, and the antenna coil 112 is configured such that the one side part 112*a*1 directly faces a side face 103*a* of a metal plate 103 and the other side part 112*a*2 is folded along a bottom face 103*b* of the metal plate 103. That is, the present embodiment is configured such that the approximately rectangular antenna coil 112, which is elongated in the longitudinal direction and whose width is larger than the thickness of the metal plate 103, is folded at the center line L1 so that the one side part 112*a*1 is arranged in a narrow space between the side face 103*a* of the metal plate 103 and an inner peripheral wall 132*a* of a housing 132 of an electronic apparatus 130 and the other side part 112*a*2 is arranged in a narrow space between the bottom face 103*b* of the metal plate 103 and a bottom face 132*b* of the housing 132.

Thus, since the distribution of a magnetic field that is produced by the antenna coil 112 can be further widened by thus providing the magnetic sheet 120 through the opening 112*b* of the antenna coil 112 so that the magnetic sheet 120 overlaps with a part of the antenna coil 112, the communication characteristics of the antenna can be brought into a more favorable condition in mounting the antenna device 101 in a limited narrow space near the side face 103*a* of the metal plate 103. In particular, in the present embodiment, since the magnetic sheet 120 is provided through the opening 112*b* in such a manner as to overlap with the outer side of one side part 112*a*1 and overlap with the inner side of other side part 112*a*2, the distribution of a magnetic field that is produced by the antenna coil 112 can be spread over a wider area including and surrounding the side face 103*a* of the metal plate 103. This makes it possible to bring the communication characteristics of the antenna into a more favorable condition in folding and mounting the antenna device 101 in a limited narrow space near the side face 103*a* of the metal plate 103.

Figure 4A:
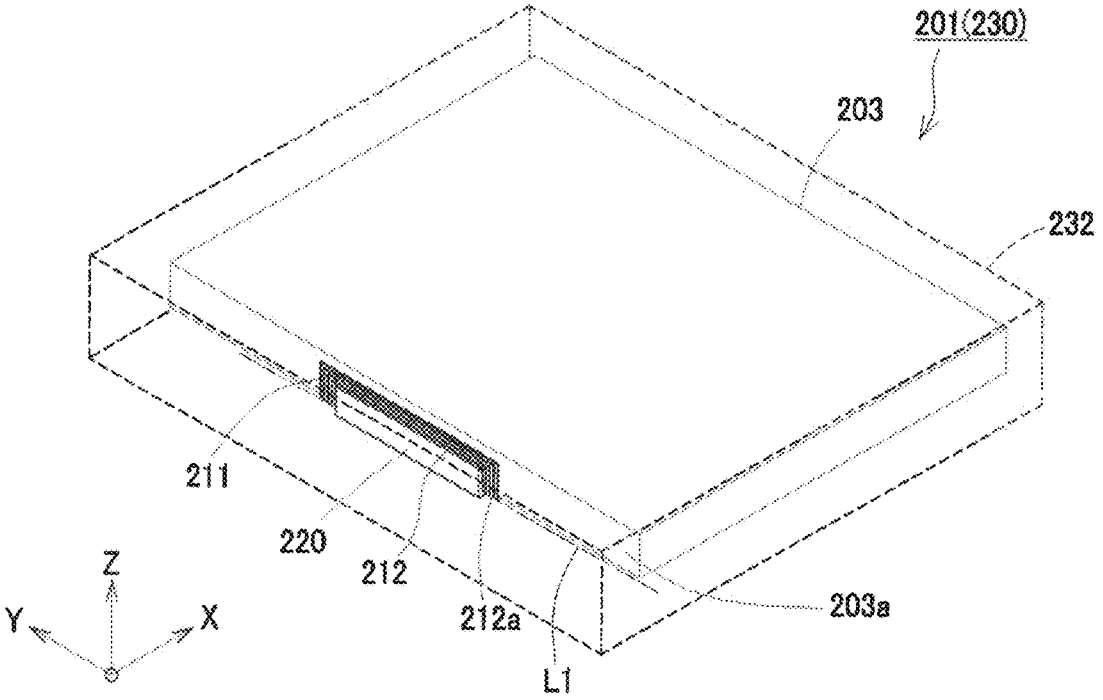
FIG. 4A is a perspective view showing an example of an antenna device according to another embodiment of the present invention.
Figure 4B:
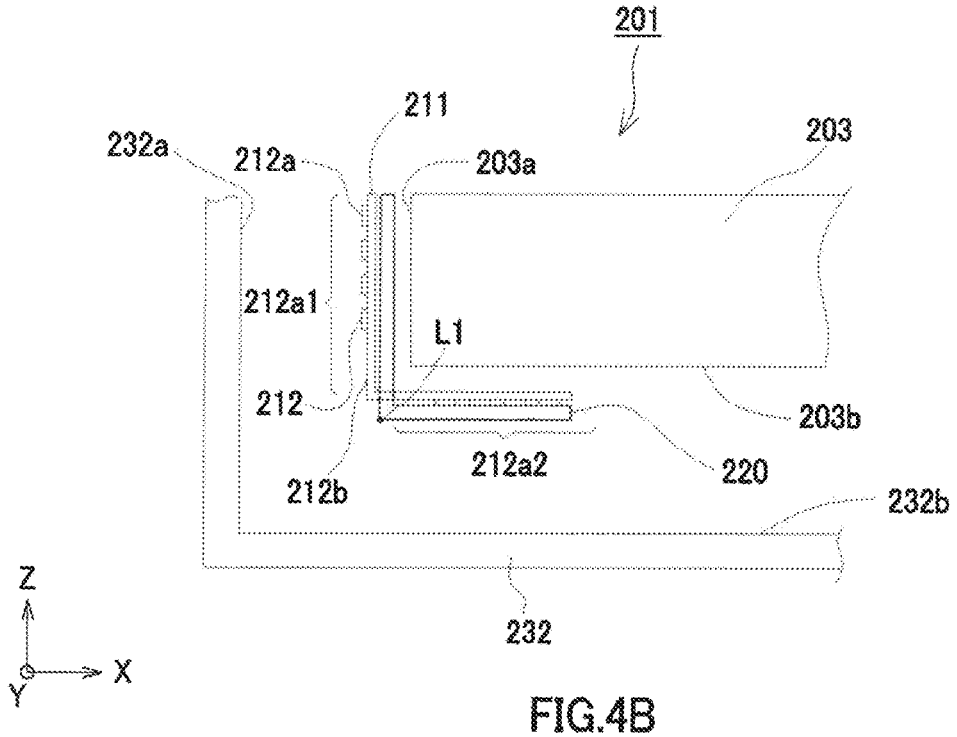
FIG. 4B is a cross-sectional view for explaining the arrangement of an antenna device according to another embodiment of the present invention.

Further, another aspect may be configured such that, as shown in FIGS. 4A and 4B, a magnetic sheet 220 is provided through an opening 212*b* of an antenna coil 212 in such a manner as to overlap with a part of the antenna coil 212. The antenna coil 212 according to the present embodiment may be configured such that by providing the magnetic sheet 220 through the opening 212*b* so that the magnetic sheet 220 overlaps with an inner side of one side part 212*a*1 and overlaps with an outer side of other side part 212*a*2, the one side part 212*a*1 faces a side face 203*a* of a metal plate 203 via the magnetic sheet 220 and the other side part 212*a*2 is folded along a bottom face 203*b* of the metal plate 203. That is, the present embodiment is configured such that the approximately rectangular antenna coil 212, which is elongated in the longitudinal direction and whose width is larger than the thickness of the metal plate 203, is folded at the center line L1 so that the one side part 212*a*1 is arranged in a narrow space between the side face 203*a* of the metal plate 203 and an inner peripheral wall 232*a* of a housing 232 of an electronic apparatus 230 and the other side part 212*a*2 is arranged in a narrow space between the bottom face 203*b* of the metal plate 203 and a bottom face 232*b* of the housing 232.

Thus, since the distribution of a magnetic field that is produced by the antenna coil 212 can be further widened by thus providing the magnetic sheet 220 through the opening 212*b* of the antenna coil 212 so that the magnetic sheet 220 overlaps with a part of the antenna coil 212, the communication characteristics of an antenna can be brought into a more favorable condition in mounting the antenna device 201 in a limited narrow space near the side face 203*a* of the metal plate 203. In particular, in the present embodiment, since the magnetic sheet 220 is provided through the opening 212*b* in such a manner as to overlap with the inner side of the one side part 212*a*1 and overlap with the outer side of the other side part 212*a*2, the distribution of a magnetic field that is produced by the antenna coil 212 can be spread over a wider area including and surrounding the side face 203*a* of the metal plate 203. This makes it possible to bring the communication characteristics of the antenna into a more favorable condition in folding and mounting the antenna device 201 in a limited narrow space near the side face 203*a* of the metal plate 203.

Figure 5A:
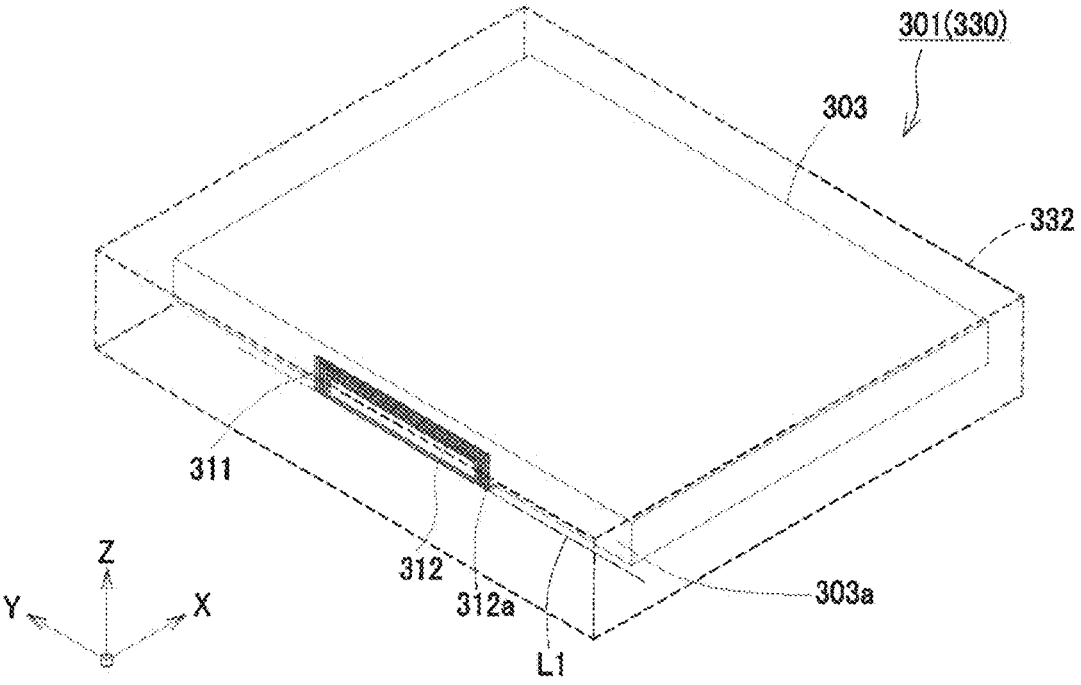
FIG. 5A is a perspective view showing an example of an antenna device according to another embodiment of the present invention.
Figure 5B:
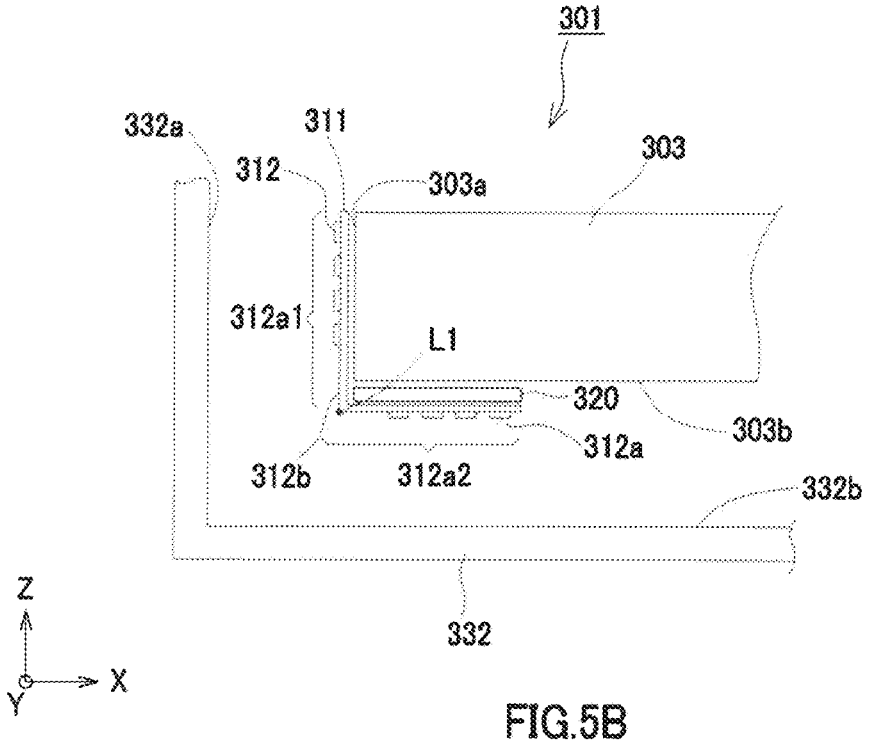
FIG. 5B is a cross-sectional view for explaining the arrangement of an antenna device according to another embodiment of the present invention.
Figure 6A:
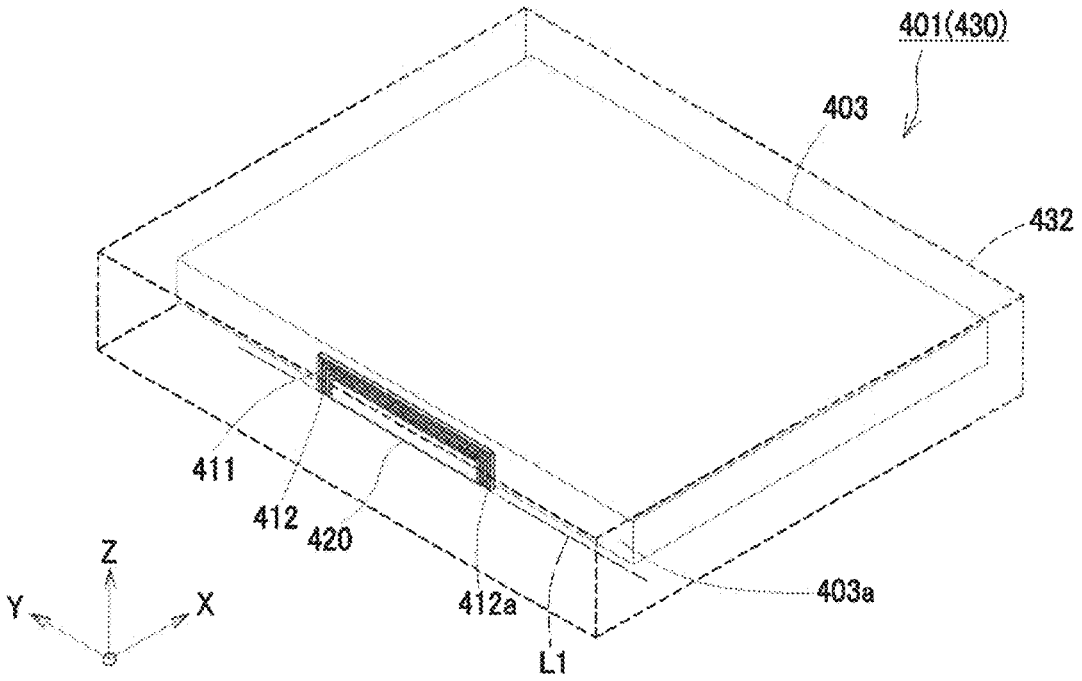
FIG. 6A is a perspective view showing an example of an antenna device according to another embodiment of the present invention.
Figure 6B:
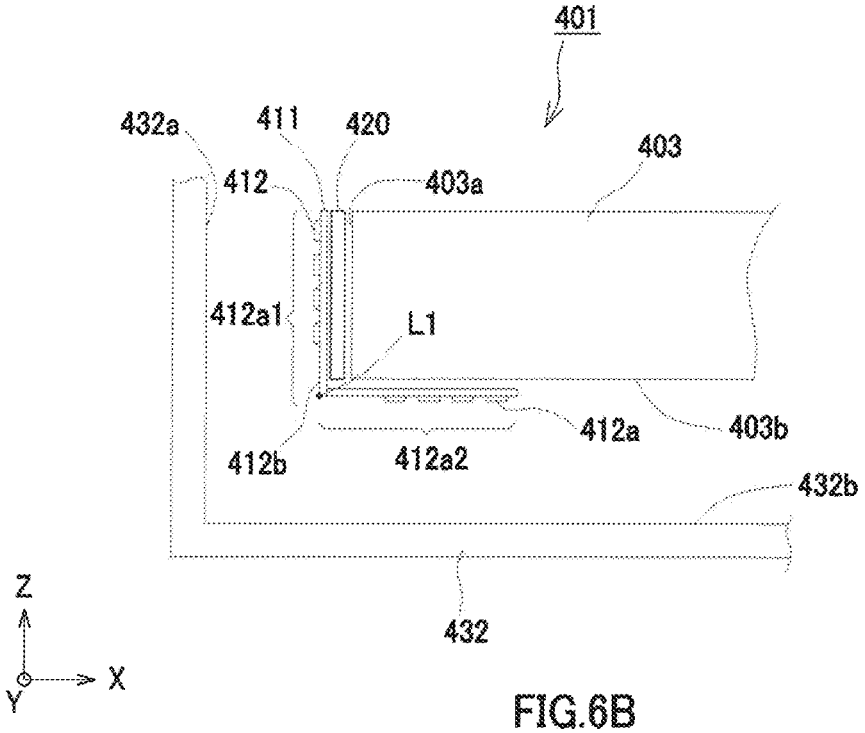
FIG. 6B is a cross-sectional view for explaining the arrangement of an antenna device according to another embodiment of the present invention.

It should be noted that the way in which the magnetic sheets 20, 120, and 220 are provided is not limited to any of the aspects of the embodiments described above. That is, as shown in FIGS. 5A and 5B, a magnetic sheet 320 may overlap only with other side part 312*a*2 without overlapping with one side part 312*a*1. Further, as shown in FIGS. 6A and 6B, a magnetic sheet 420 may overlap only with one side part 412*a*1 without overlapping with other side part 412*a*2. Since the distribution of a magnetic field that is produced by the antenna coil 312 or 412 can be further widened by thus providing the magnetic sheet 320 or 420 so that the magnetic sheet 320 or 420 overlaps only with either the other side part 312*a*2 or the one side part 412*a*1, satisfactory communication performance can be ensured even in the case of folding and mounting in a limited narrow space near a side face 303*a* or 403*a* of a metal plate 303 or 403.

Figure 7A:
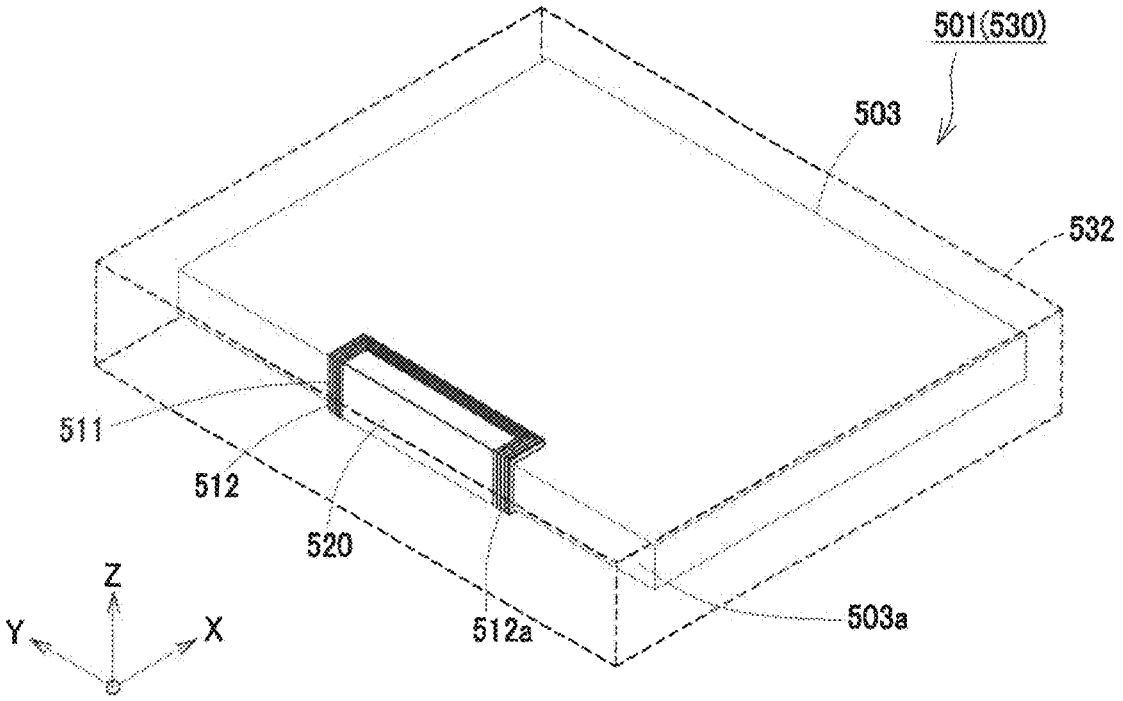
FIG. 7A is a perspective view showing an example of an antenna device according to another embodiment of the present invention.
Figure 7B:
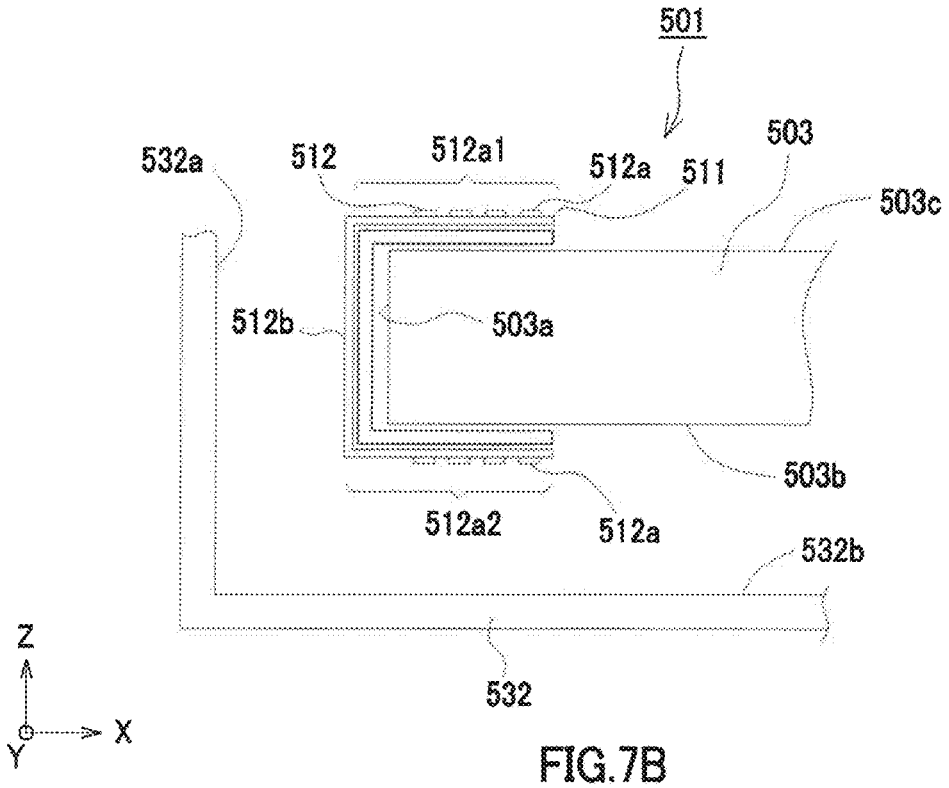
FIG. 7B is a cross-sectional view for explaining the arrangement of an antenna device according to another embodiment of the present invention.

Furthermore, as shown in FIGS. 7A and 7B, an approximately rectangular antenna coil 512, which is elongated in the longitudinal direction and whose width is larger than the thickness of a metal plate 503, may be configured such that an end side of one side part 512*a*1 of the antenna coil 512 is folded along a top face 503*c* of the metal plate 503 and an end side of other side part 512*a*2 of the antenna coil 512 is folded along a bottom face 503*b* of the metal plate 503. That is, the present embodiment is configured such that the approximately rectangular antenna coil 512 is folded at both end sides thereof in a width direction so that the end side of the one side part 512*a*1 in which a conducting wire 512*a* is provided extends along the top face 503*c* of the metal plate 503 and an opening 512*b* extends between a side face 503*a* of the metal plate 503 and an inner peripheral wall 532*a* of a housing 532 of an electronic apparatus 530 and the other side part 512*a*2 in which the conducting wire 512*a* is provided is arranged in a narrow space between the bottom face 503*b* of the metal plate 503 and a bottom face 532*b* of the housing 532. By configuring an antenna device 501 in this manner, the distribution of a magnetic field that is produced by the antenna coil 512 can be spread over an area including both the top face side and back face side of the metal plate 503. This makes it possible to achieve satisfactory communication characteristics of an antenna while mounting the antenna device 501 in a limited narrow space near the side face of the metal plate 503.

EXAMPLES

Next, examples of examinations and evaluations of an antenna device according to an embodiment of the present invention are described with reference to the drawings. It should be noted that the present invention is not limited to the present examples.

First, examples showing the results of evaluations of magnetic field strength on the basis of changes in configuration of antenna coil of an antenna device according to an embodiment of the present invention are described with reference to the drawings.

Figure 8A:
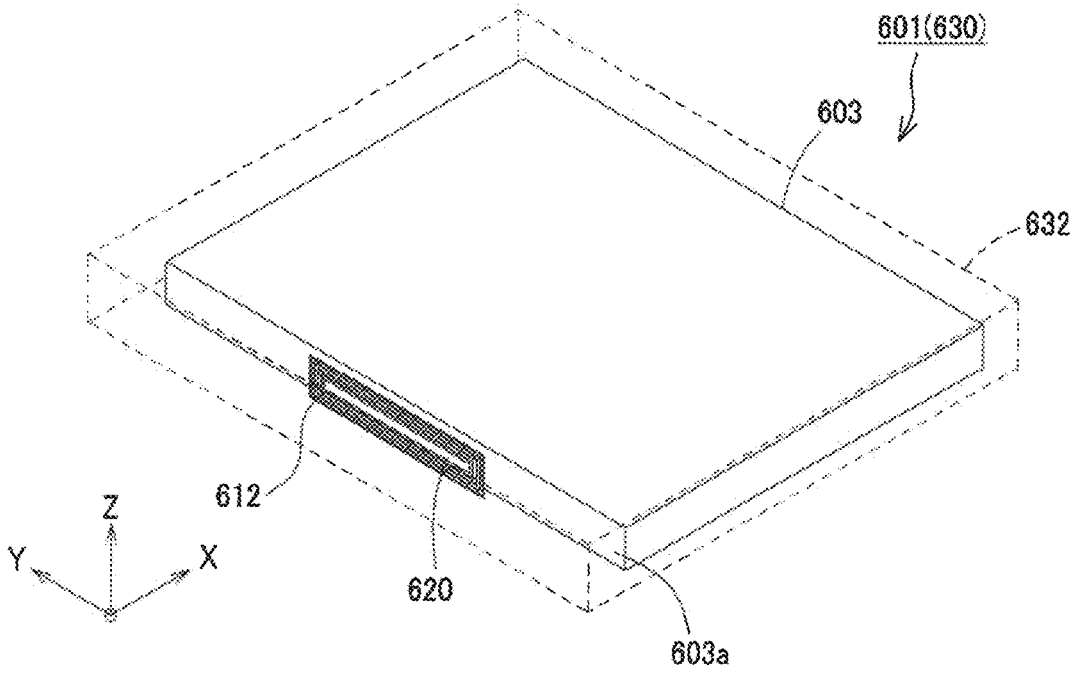
FIG. 8A is a perspective view schematically showing a configuration of an antenna device serving as a comparative example of an antenna device according to an embodiment of the present invention.
Figure 8B:
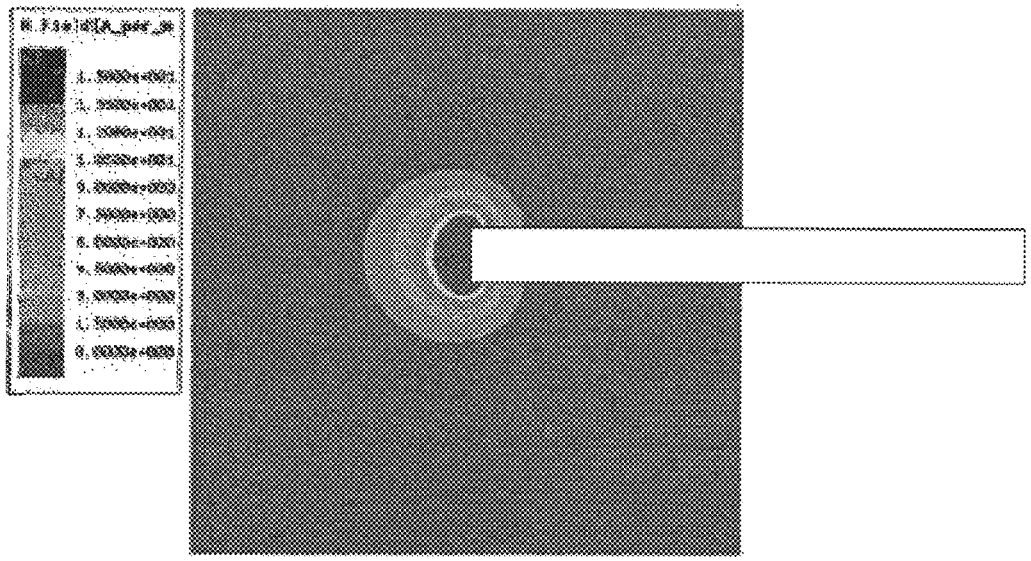
FIG. 8B is a diagram showing the magnetic field strength of the antenna device shown in FIG. 8A.

FIG. 8A is a perspective view schematically showing a configuration of an antenna device serving as a comparative example of an antenna device according to an embodiment of the present invention. FIG. 8B is a diagram showing the magnetic field strength of the antenna device shown in FIG. 8A. An antenna device 601 serving as the comparative example was configured such that an antenna coil 612 measuring 30 mm×5 mm and consisting of four turns of conducting wire was provided on a side face 603*a* of a metal plate 603 included in an aluminum housing 632 measuring 50 mm×50 mm×5 mm. For the distribution of the magnetic field strength that was produced in the antenna coil 612 in a state where an electric power of 0.1 W was fed to a terminal of the antenna device 601, a cross-section of the antenna coil 612 was observed. As shown in FIG. 8B, it was found that a strong magnetic field distribution appears on and around the side face 603*a* of the metal plate 603.

Figure 9A:
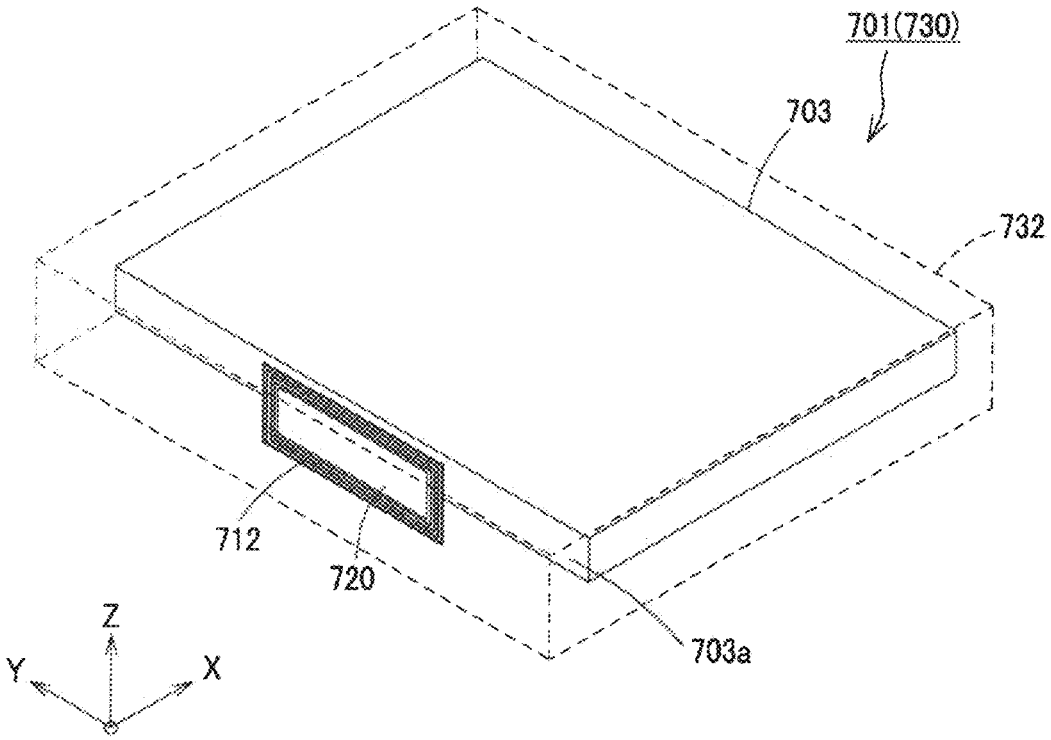
FIG. 9A is a perspective view schematically showing a configuration of an antenna device serving as another comparative example of an antenna device according to an embodiment of the present invention.
Figure 9B:
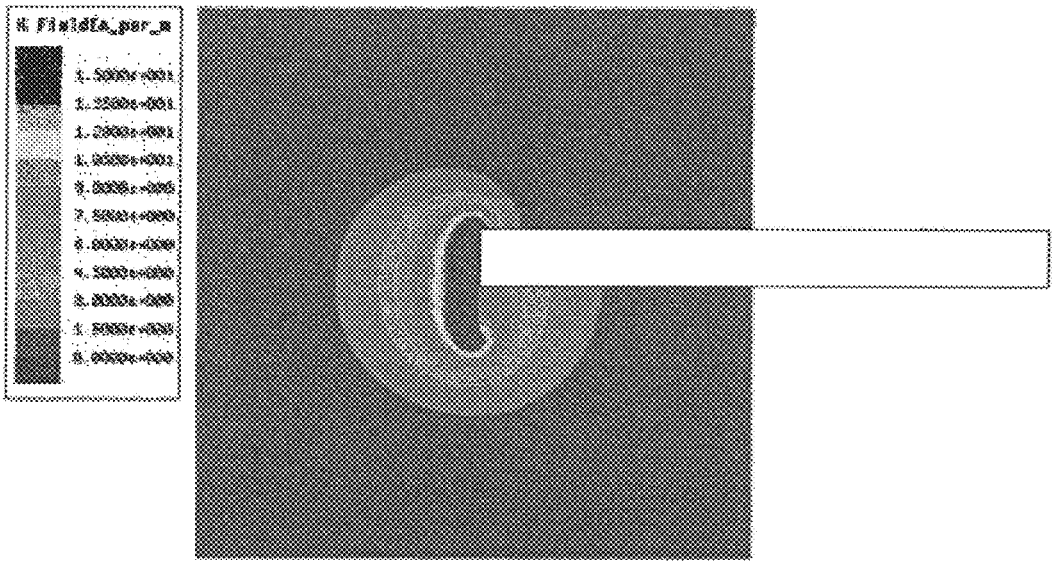
FIG. 9B is a diagram showing the magnetic field strength of the antenna device shown in FIG. 9A.

FIG. 9A is a perspective view schematically showing a configuration of an antenna device serving as another comparative example of an antenna device according to an embodiment of the present invention. FIG. 9B is a diagram showing the magnetic field strength of the antenna device shown in FIG. 9A. An antenna device 701 serving as the comparative example included an antenna coil 712 that was twice wider than that of the comparative example shown in FIG. 8A, and the magnetic field strength that was produced in the antenna coil 712 was observed. That is, in the present comparative example, in which the antenna coil 712 measuring 30 mm×10 mm and consisting of four turns of conducting wire was provided on a side face 703*a* of a metal plate 703 included in an aluminum housing 732 measuring 50 mm×50 mm×5 mm, a cross-section of the antenna coil 712 was observed for the distribution of the magnetic field strength that was produced in the antenna coil 712 in a state where an electric power of 0.1 W was fed to a terminal of the antenna device 701.

As shown in FIG. 9B, it was found that a strong magnetic field distribution appears in and around a portion of the antenna coil 712 that protrudes from the side face 703*a* of the metal plate 703. That is, it was found that increasing the width of the antenna coil 712 expands the distribution of the magnetic field strength that was produced in the antenna coil 712.

Next, in view of the distribution result of magnetic field strength of the antenna coil 712 according to the comparative example of FIG. 9A, the magnetic field strength distribution of an example of the antenna device 1 (see FIG. 2) according to an embodiment of the present invention was observed. In the present example, in which the antenna coil 12 measuring 30 mm×10 mm and consisting of four turns of conducting wire had a portion protruding from the side face 3*a* of the metal plate 3 and, with the portion folded, the antenna coil 12 was provided on the side face 3*a* of the metal plate 3 included in the aluminum housing 32 measuring 50 mm×50 mm×5 mm, a cross-section of the antenna coil 12 was observed for the distribution of the magnetic field strength that was produced in the antenna coil 12 in a state where an electric power of 0.1 W was fed to a terminal of the antenna device 1.

Figure 10:
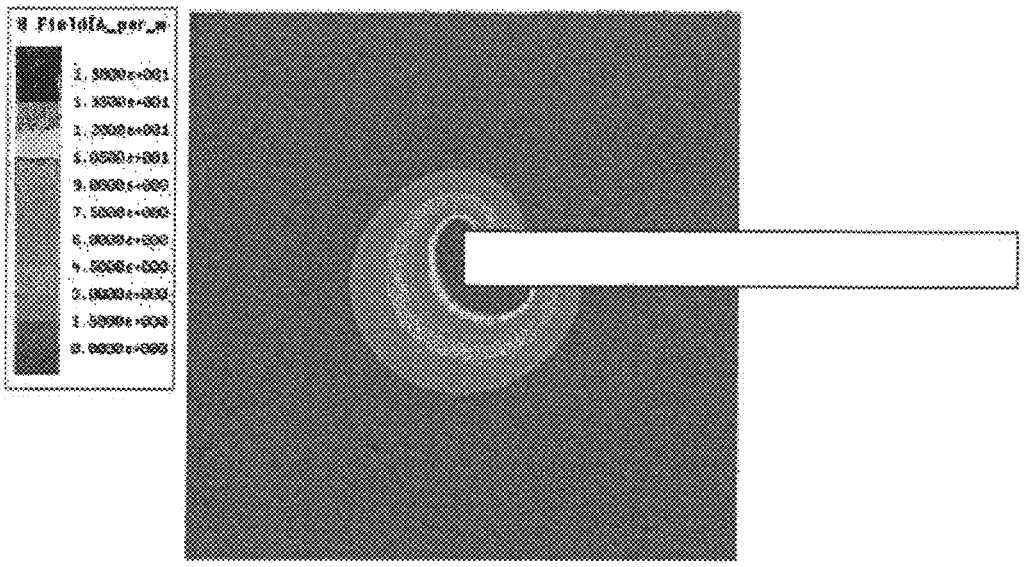
FIG. 10 is a diagram showing the magnetic field strength of an example of an antenna device according to an embodiment of the present invention.

FIG. 10 is a diagram showing the magnetic field strength of an example of the antenna device 1 (see FIG. 2) according to an embodiment of the present invention. As shown in FIG. 10, it was found that folding the portion of the antenna coil 12 that protrudes from the side face 3*a* of the metal plate 3 causes a strong magnetic field distribution to appear around an area extending from the side face 3*a* to the bottom face 3*b* of the metal plate 3. That is, it was found that by folding the antenna coil 12, the distribution region of the magnetic field strength that is produced in the antenna coil 12 is expanded from the side face 3*a* to the bottom face 3*b* of the metal plate 3.

Next, the magnetic field strength distribution of an example of the antenna device 101 (see FIG. 3) according to another embodiment of the present invention was observed. In the present example, in which the antenna coil 112 measuring 30 mm×10 mm and consisting of four turns of conducting wire had a portion protruding from the side face 103*a* of the metal plate 103 and, with the portion folded, the antenna coil 112 was provided on the side face 103*a* of the metal plate 103 included in the aluminum housing 132 measuring 50 mm×50 mm×5 mm, a cross-section of the antenna coil 112 was observed for the distribution of the magnetic field strength that was produced in the antenna coil. 112 in a state where an electric power of 0.1 W was fed to a terminal of the antenna device 101.

Figure 11:
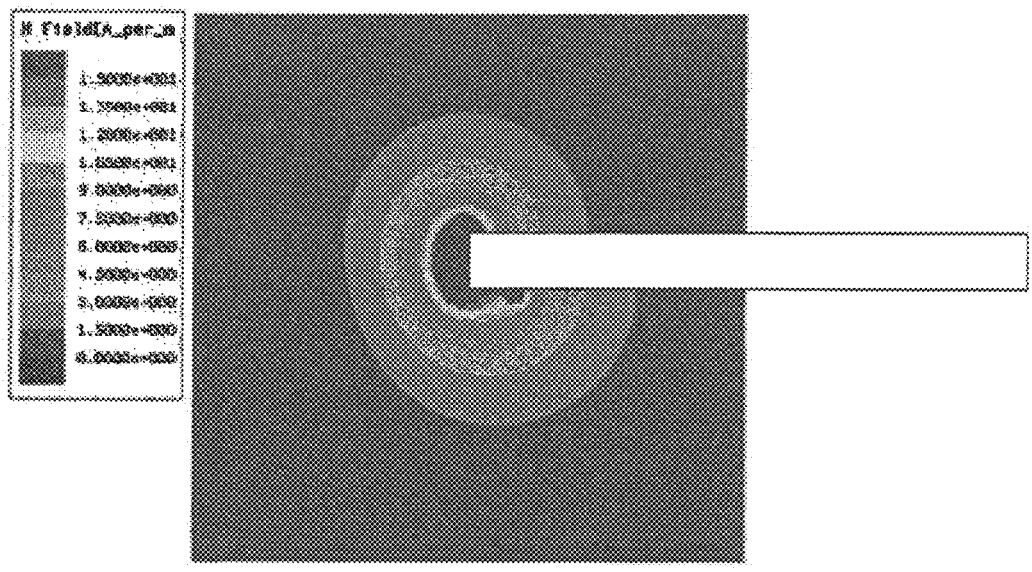
FIG. 11 is a diagram showing the magnetic field strength of an example of an antenna device according to another embodiment of the present invention.

FIG. 11 is a diagram showing the magnetic field strength of an example of the antenna device 101 according to another embodiment of the present invention. As shown in FIG. 11, it was found that folding the portion of the antenna coil 112 that protrudes from the side face 103*a* of the metal plate 103 causes a strong magnetic field distribution to appear around an area extending from the side face 103*a* to the bottom face 103*b* of the metal plate 103.

In the present example, since the magnetic sheet 120 is provided through the opening 112*b* in such a manner as to overlap with the outer side of the one side part 112*a*1 and overlap with the inner side of the other side part 112*a*2, it was found that the distribution of a magnetic field that is produced by the antenna coil 112 is spread over a wider area including and surrounding the side face 103*a* of the metal plate 103. In particular, in the present example, it was found that a magnetic field having a certain intensity was distributed not only on the side face 103*a* of the metal plate 103 but also in an area extending to both the top face side and bottom face side of the metal plate 103. From this, it was found that the antenna device 101 according to the present example has a wider distribution range of a magnetic field having a predetermined or higher intensity.

Next, the magnetic field strength distribution of an example of the antenna device 201 (see FIG. 4) according to another embodiment of the present invention was observed. In the present example, in which the antenna coil 212 measuring 30 mm×10 mm and consisting of four turns of conducting wire had a portion protruding from the side face 203*a* of the metal plate 203 and, with the portion folded, the antenna coil 212 was provided on the side face 203*a* of the metal plate 203 included in the aluminum housing 232 measuring 50 mm×50 mm×5 mm, a cross-section of the antenna coil 212 was observed for the distribution of the magnetic field strength that was produced in the antenna coil 212 in a state where an electric power of 0.1 W was fed to a terminal of the antenna device 201.

Figure 12:
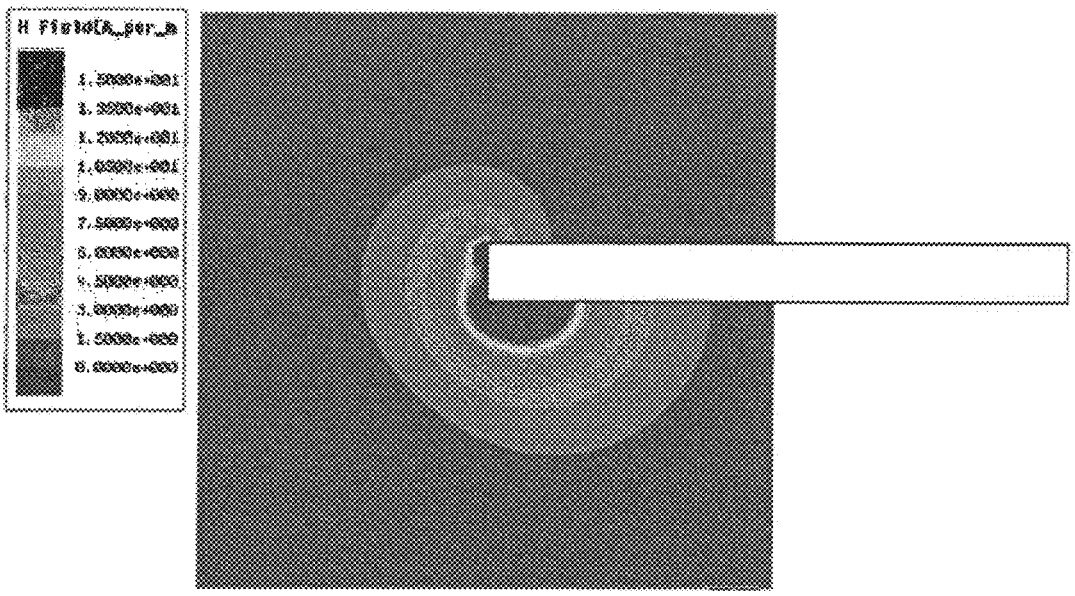
FIG. 12 is a diagram showing the magnetic field strength of an example of an antenna device according to another embodiment of the present invention.

FIG. 12 is a diagram showing the magnetic field strength of an example of the antenna device 201 according to another embodiment of the present invention. As shown in FIG. 12, it was found that folding the portion of the antenna coil 212 that protrudes from the side face 203*a* of the metal plate 203 causes a strong magnetic field distribution to appear around an area extending from the side face 203*a* to the bottom face 203*b* of the metal plate 203.

In the present example, since the magnetic sheet 220 is provided through the opening 212*b* in such a manner as to overlap with the inner side of the one side part 212*a*1 and overlap with the outer side of the other side part 212*a*2, it was found that the distribution of a magnetic field that is produced by the antenna coil 212 is spread over a wider area including and surrounding the side face 203*a* of the metal plate 203. In particular, in the present example, it was found that a magnetic field having a certain intensity was distributed not only on the side face 203*a* of the metal plate 203 but also in an area extending to the bottom face side of the metal plate 203. From this, it was found that the antenna device 201 according to the present example has a wider magnetic field distribution range than the antenna device 1 of the aforementioned example and therefore has a wider distribution range of a magnetic field having a predetermined or higher intensity, although it does not have a wider magnetic field distribution range than the antenna device 101 of the aforementioned example.

Next, the magnetic field strength distribution of an example of the antenna device 301 (see FIG. 5) according to another embodiment of the present invention was observed. In the present example, in which the antenna coil 312 measuring 30 mm×10 mm and consisting of four turns of conducting wire had a portion protruding from the side face 303*a* of the metal plate 303 and, with the portion folded, the antenna coil 312 was provided on the side face 303*a* of the metal plate 303 included in the aluminum housing 332 measuring 50 mm×50 mm×5 mm, a cross-section of the antenna coil 312 was observed for the distribution of the magnetic field strength that was produced in the antenna coil 312 in a state where an electric power of 0.1 W was fed to a terminal of the antenna device 301.

Figure 13:
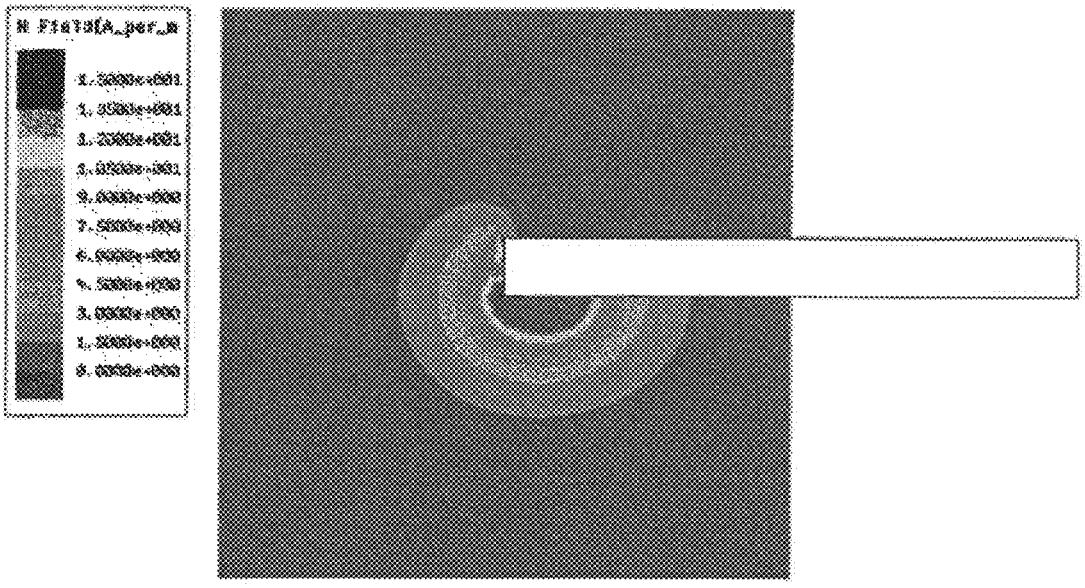
FIG. 13 is a diagram showing the magnetic field strength of an example of an antenna device according to another embodiment of the present invention.

FIG. 13 is a diagram showing the magnetic field strength of an example of an antenna device 301 according to another embodiment of the present invention. As shown in FIG. 13, it was found that folding the portion of the antenna coil 312 that protrudes from the side face 303*a* of the metal plate 303 causes a strong magnetic field distribution to appear around an area extending from the side face 303*a* to the bottom face 303*b* of the metal plate 303.

In the present example, since the magnetic sheet 320 is provided in such a manner as to overlap only with the inner side of the other side part 312*a*2, it was found that the distribution of a magnetic field that is produced by the antenna coil 312 is spread over a wider area centered at and surrounding the bottom face 303*b* of the metal plate 303. In particular, in the present example, it was found that a magnetic field having a certain intensity was distributed not only on the bottom face 303*b* of the metal plate 303 but also in an area extending to the side face side of the metal plate 303. From this, it was found that the antenna device 301 according to the present example has a wider distribution range of a magnetic field having a predetermined or higher intensity, although it has a narrower distribution range of a magnetic field than the examples of the aforementioned antenna devices 101 and 201.

Next, the magnetic field strength distribution of an example of the antenna device 401 (see FIG. 6) according to another embodiment of the present invention was observed. In the present example, in which the antenna coil 412 measuring 30 mm×10 mm and consisting of four turns of conducting wire had a portion protruding from the side face 403*a* of the metal plate 403 and, with the portion folded, the antenna coil 412 was provided on the side face 403*a* of the metal plate 403 included in the aluminum housing 432 measuring 50 mm×50 mm×5 mm, a cross-section of the antenna coil 412 was observed for the distribution of the magnetic field strength that was produced in the antenna coil 412 in a state where an electric power of 0.1 W was fed to a terminal of the antenna device 401.

Figure 14:
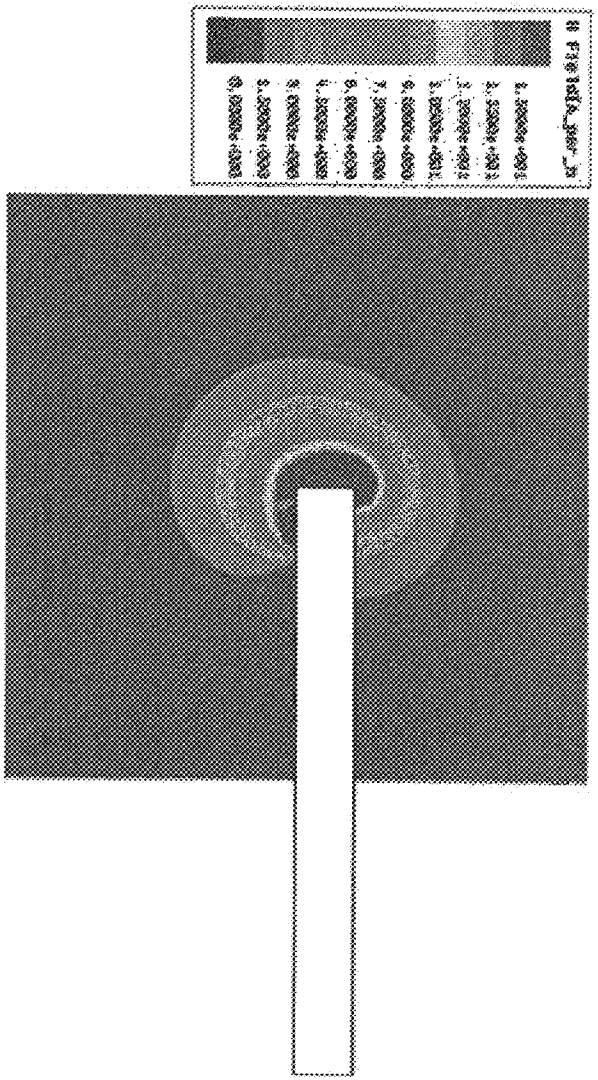
FIG. 14 is a diagram showing the magnetic field strength of an example of an antenna device according to another embodiment of the present invention.

FIG. 14 is a diagram showing the magnetic field strength of an example of an antenna device 401 according to another embodiment of the present invention. As shown in FIG. 14, it was found that folding the portion of the antenna coil 412 that protrudes from the side face 403*a* of the metal plate 403 causes a strong magnetic field distribution to appear around an area extending from the side face 403*a* to the bottom face 403*b* of the metal plate 403.

In the present example, since the magnetic sheet 420 is provided in such a manner as to overlap only with the inner side of the one side part 412*a*1, it was found that the distribution of a magnetic field that is produced by the antenna coil 412 is spread over a wider area centered at and surrounding the side face 403*a* of the metal plate 403. In particular, in the present example, it was found that a magnetic field having a certain intensity was distributed not only on the side face 403*a* of the metal plate 403 but also in an area extending to the top face and bottom face side of the metal plate 403. From this, it was found that the antenna device 401 according to the present example has a wider distribution range of a magnetic field having a predetermined or higher intensity, although it has a narrower distribution range of a magnetic field than the examples of the aforementioned antenna devices 101 and 201.

From these verification results of magnetic field strength, it was found that an example of the antenna device 101 according to another embodiment of the present invention has the widest magnetic field distribution and therefore can ensure more satisfactory communication performance. That is, it was found that, for ensuring of more satisfactory antenna communication performance, such a configuration is preferable that in providing the magnetic sheet 120 through the opening 112*b* of the antenna coil 112, the opening 112*b* is passed through so that the magnetic sheet 120 overlaps with the outer side of the one side part 112*a*1 and overlaps with the inner side of the other side part 112*a*2, the one side part 112*a* faces the side face 103*a* of the metal plate 103, and the other side part 112*a*2 faces the bottom face 103*b* of the metal plate 103 via the magnetic sheet 120.

Figure 15A:
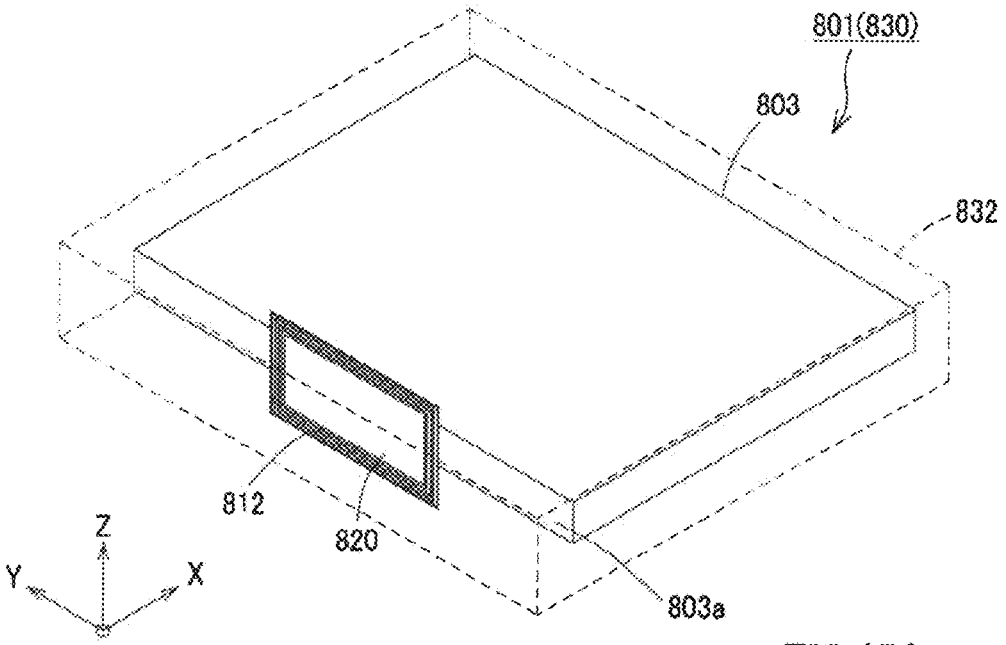
FIG. 15A is a perspective view schematically showing a configuration of an antenna device serving as another comparative example of an antenna device according to another embodiment of the present invention.
Figure 15B:
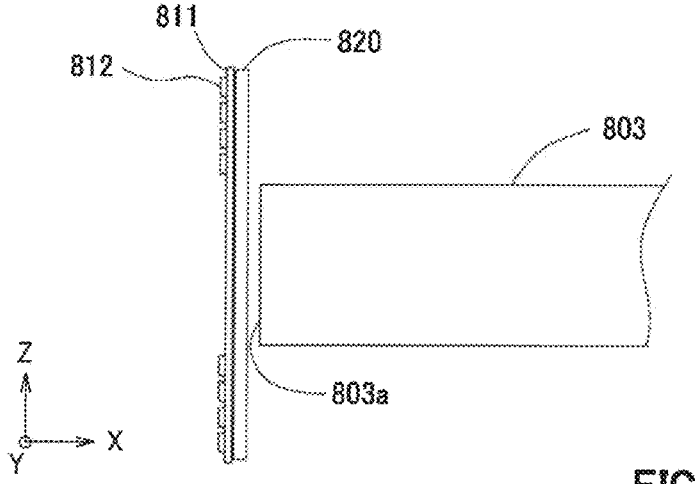
FIG. 15B is a cross-sectional view for explaining the arrangement of an antenna device serving as another comparative example of an antenna device according to another embodiment of the present invention.
Figure 15C:
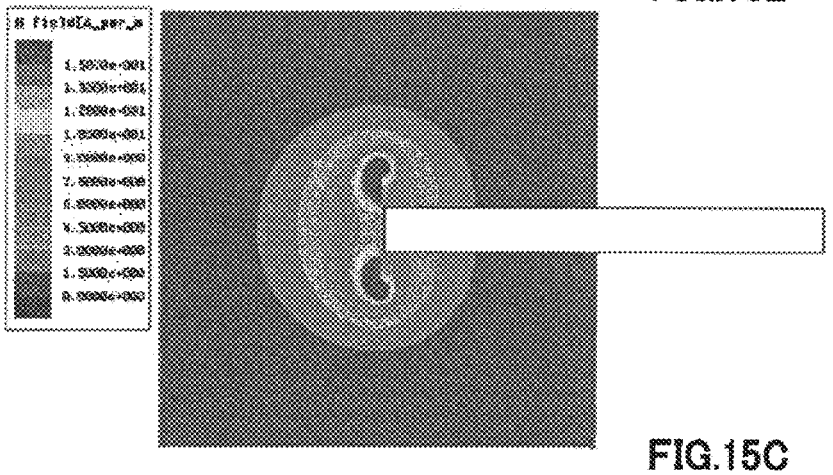
FIG. 15C is a diagram showing the magnetic field strength of the antenna device shown in FIG. 15A.

FIG. 15A is a perspective view schematically showing a configuration of an antenna device serving as another comparative example of an antenna device according to another embodiment of the present invention. FIG. 15B is a cross-sectional view for explaining the arrangement of an antenna device serving as another comparative example of an antenna device according to another embodiment of the present invention. FIG. 15C is a diagram showing the magnetic field strength of the antenna device shown in FIG. 15A.

An antenna device 801 serving as the comparative example was configured such that an antenna coil 812 measuring 30 mm×15 mm and consisting of four turns of conducting wire was provided on a side face 803*a* of a metal plate 803 included in an aluminum housing 832 measuring 50 mm×50 mm×15 mm. For the distribution of the magnetic field strength that was produced in the antenna coil 812 in a state where an electric power of 0.1 W was fed to a terminal of the antenna device 801, a cross-section of the antenna coil 812 was observed. As shown in FIG. 15C, it was found that a strong magnetic field distribution appears on and around the side face 803*a* of the metal plate 803, centered at the site where the antenna coil 812 is provided.

Next, the magnetic field strength distribution of an example the antenna device 501 (see FIG. 7) according to anther embodiment of the present invention was observed. In the present example, in which the antenna coil 512 measuring 30 mm×15 mm and consisting of four turns of conducting wire had portions protruding from the side face 503*a* of the metal plate 503 and, with the portions folded from both end sides, respectively, the antenna coil 512 was provided on the side face 503*a* of the metal plate 503 included in the aluminum housing 532 measuring 50 mm×50 mm×5 mm, a cross-section of the antenna coil 512 was observed for the distribution of the magnetic field strength that was produced in the antenna coil 512 in a state where an electric power of 0.1 W was fed to a terminal of the antenna device 501.

Figure 16:
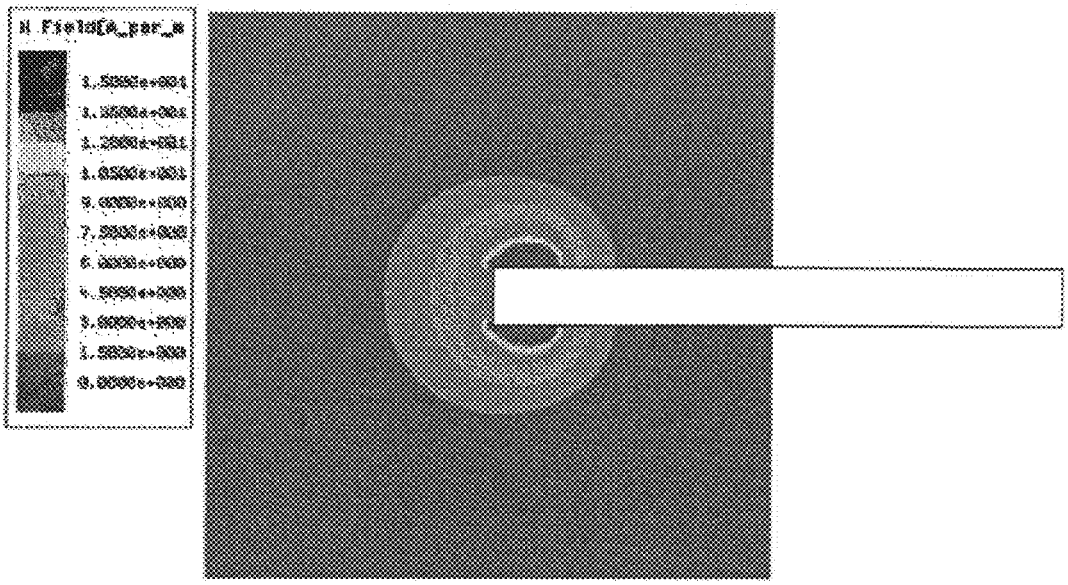
FIG. 16 is a diagram showing the magnetic field strength of an example of an antenna device according to another embodiment of the present invention.

FIG. 16 is a diagram showing the magnetic field strength of an example of the antenna device 501 according to another embodiment of the present invention. As shown in FIG. 16, it was found that strong magnetic field distributions appear in areas centered at and surrounding ends of the top face side and bottom face side of the metal plate 503, respectively, centered at the site where the conducting wire 512*a* of the antenna coil 512 is provided. From this, it was found that the antenna device 501 according to the present example is suitable to a laptop personal computer required to have communication performance from both the front face and back face of the metal plate 503.

While embodiments and examples of the present invention have been described in detail above, it is easily understood by persons skilled in the art that many modifications are possible without substantially departing from the new matters and effects of the present invention. Therefore, all such modifications are encompassed in the scope of the present invention.

For example, a term used at least once in the description or drawings together with a different term that is broader or the same in meaning can also be replaced the different term in any place in the description or drawings. Further, the configurations and operations of an antenna device and an electronic apparatus are not limited to those described in embodiments and examples of the present invention but may be carried out in various modifications.

GLOSSARY OF DRAWING REFERENCES

1, 101, 201, 301, 401, 501 Antenna Device
2 Antenna Module
3, 103, 203, 303, 403, 503 Metal plate (First Conductor)
3*a*, 103*a*, 203*a*, 303*a*, 403*a*, 503*a* Side Face (of Metal plate)
3*b*, 103*b*, 203*b*, 303*b*, 403*b*, 503*b* Bottom. Face (of Metal plate)
11, 111, 211, 311, 411, 511 Antenna Substrate
12, 112, 212, 312, 412, 512 Antenna Coil
12*a*, 112*a*, 212*a*, 312*a*, 412*a*, 512*a* Conducting Wire
12*a*1, 112*a*1, 212*a*1, 312*a*1, 412*a*1, 512*a*1 One Side Part
12*a*2, 112*a*2, 212*a*2, 312*a*2, 412*a*2, 512*a*2 Other Side Part
12*b*, 112*b*, 212*b*, 312*b*, 412*b*, 512*b* Opening
13 Communication Processing Unit
14 Terminal Area
20, 120, 220, 320, 420, 520 Magnetic Sheet
30 Electronic Apparatus
32 Housing
32*a* inner Peripheral Wall (of Housing)
40 Reader/Writer (External Device)
41 Antenna
42 Control Board
43 Control Circuit
L1 Center Line

The invention claimed is:

1. An antenna device incorporated in an electronic apparatus, and communicates with an external device via an electromagnetic field signal, comprising:

a metal plate provided inside a housing of the electronic apparatus and facing the external device;

an antenna coil provided by winding a conducting wire in an approximately rectangular shape so that parts of the conducting wire that face each other in a width direction via an opening of the antenna coil come close to each other, configured such that a width of the antenna coil is larger than a thickness of the metal plate, and inductively coupled to the external device; and a magnetic sheet formed of a magnetic substance and provided in such a manner as to overlap with a part of the antenna coil, wherein the antenna coil is provided along a side face of the metal plate and configured such that a portion of the antenna coil that protrudes from a region overlapping the side face of the metal plate is folded along at least either a top or bottom face of the metal plate.

2. The antenna device according to claim 1, wherein the magnetic sheet is provided through the opening in such a manner as to overlap with a part of the antenna coil.

3. The antenna device according to claim 2, wherein the antenna coil is divided into two parts at a center line longitudinally traversing the opening in a longitudinal direction of the antenna coil, the two parts being one side part in which the conducting wire turns around in one direction and other side part in which the conducting wire turns around in other direction, the magnetic sheet is provided through the opening in such a manner as to overlap with an outer side of the one side part and overlap with an inner side of the other side part, and the antenna coil is configured such that the one side part directly faces the side face of the metal plate and the other side part is folded along the bottom face of the metal plate.

4. The antenna device according to claim 2, wherein the antenna coil is divided into two parts at a center line longitudinally traversing the opening in a longitudinal direction of the antenna coil, the two parts being one side part in which the conducting wire turns around in one direction and other side part in which the conducting wire turns around in other direction, the magnetic sheet is provided through the opening in such a manner as to overlap with an inner side of the one side part and overlap with an outer side of the other side part, and the antenna coil is configured such that the one side part faces the side face of the metal plate via the magnetic sheet and the other side part is folded along the bottom face of the metal plate.

5. The antenna device according to claim 1, wherein the antenna coil is divided into two parts at a center line longitudinally traversing the opening in a longitudinal direction of the antenna coil, the two parts being one side part in which the conducting wire turns around in one direction and other side part in which the conducting wire turns around in other direction, and the magnetic sheet is provided in such a manner as to overlap only with either the one side part or the other side part.

6. The antenna device according to claim 1, wherein the antenna coil is divided into two parts at a center line longitudinally traversing the opening in a longitudinal direction of the antenna coil, the two parts being one side part in which the conducting wire turns around in one direction and other side part in which the conducting wire turns around in other direction, and the antenna coil is configured such that an end side of the one side part is folded along the top face of the metal plate and an end side of the other side part is folded along the bottom face of the metal plate.

7. An electronic apparatus that is able to communicate with an external device via an electromagnetic field signal, comprising the antenna device according to claim 1.

8. An electronic apparatus that is able to communicate with an external device via an electromagnetic field signal, comprising the antenna device according to claim 2.

9. An electronic apparatus that is able to communicate with an external device via an electromagnetic field signal, comprising the antenna device according to claim 3.

10. An electronic apparatus that is able to communicate with an external device via an electromagnetic field signal, comprising the antenna device according to claim 4.

11. An electronic apparatus that is able to communicate with an external device via an electromagnetic field signal, comprising the antenna device according to claim 5.

12. An electronic apparatus that is able to communicate with an external device via an electromagnetic field signal, comprising the antenna device according to claim 6.

* * * * *